US008940160B2

(12) United States Patent
Lill

(10) Patent No.: US 8,940,160 B2
(45) Date of Patent: Jan. 27, 2015

(54) RECESSED RESTRICTOR PLATE

(75) Inventor: Clifford F. Lill, Harrison, NJ (US)

(73) Assignee: Campbell-Ers L.L.C., Harrison, NJ (US)

( * ) Notice: Subject to any disclaimer, the term of this patent is extended or adjusted under 35 U.S.C. 154(b) by 566 days.

(21) Appl. No.: 13/295,663

(22) Filed: Nov. 14, 2011

(65) Prior Publication Data

US 2012/0292239 A1 Nov. 22, 2012

Related U.S. Application Data

(60) Provisional application No. 61/413,457, filed on Nov. 14, 2010.

(51) Int. Cl.
*E03F 5/06* (2006.01)
*E03F 5/046* (2006.01)

(52) U.S. Cl.
CPC .. *E03F 5/06* (2013.01); *E03F 5/046* (2013.01)
USPC ..... 210/162; 210/163; 210/170.03; 210/232; 404/4

(58) Field of Classification Search
CPC ..... E03F 5/0404; E03F 5/046; E03F 5/06; E03F 5/14; C02F 2103/001; B01D 2221/12
USPC ..... 210/162, 163, 170.03, 232, 473, 477; 404/2, 4, 5
See application file for complete search history.

(56) References Cited

U.S. PATENT DOCUMENTS

| | | | | | |
|---|---|---|---|---|---|
| 248,559 | A * | 10/1881 | Jackson | 404/4 |
| 1,245,903 | A * | 11/1917 | Gross | 210/163 |
| RE23,205 | E * | 3/1950 | Crocker | 210/163 |
| 4,594,157 | A * | 6/1986 | McGowan | 210/163 |
| 7,128,495 | B1 | 10/2006 | Lill et al. | |
| 7,160,048 | B1 | 1/2007 | Fattori et al. | |
| 7,179,371 | B1 * | 2/2007 | Bistline | 210/163 |
| 7,993,072 | B2 * | 8/2011 | Lill | 404/4 |
| 8,017,006 | B2 * | 9/2011 | Lopez | 210/163 |
| 8,235,624 | B2 * | 8/2012 | Lill | 404/4 |
| 8,522,408 | B2 * | 9/2013 | Lill | 404/5 |
| 8,657,524 | B2 * | 2/2014 | Lill | 404/4 |
| 2009/0067922 | A1 * | 3/2009 | Fattori et al. | 404/4 |
| 2012/0294676 | A1 * | 11/2012 | Lill | 404/4 |

* cited by examiner

*Primary Examiner* — Christopher Upton

(57) ABSTRACT

A restrictor plate assembly 10 is disclosed for restricting particulate flow into a curb box 12, through a mouth 14 thereof. The assembly 10 includes a restrictor plate 16 adapted for being secured at an inside surface 18 of the curb box mouth 14. A proximate clamp structure 20 is positioned at a proximate end 22 the restrictor plate 16 and a distal clamp structure 24 is positioned at a distal end 26 of the restrictor plate 16 that is width-wise spaced from the proximate end 26 of the restrictor plate. The proximate and distal clamp structures 20, 24 are adapted for securing the restrictor plate 16 within the curb box 12 without gripping the inside surface 18 or an outside surface 28 of the curb box mouth 14.

18 Claims, 8 Drawing Sheets

RECESSED RESTRICTOR PLATE

CROSS REFERENCE TO RELATED APPLICATIONS

This application claims priority to U.S. Prov. Patent Application No. 61/413,457 to Lill, filed on Nov. 14, 2010, the disclosure of which is entirely incorporated herein by reference.

BACKGROUND

1. Field of the Disclosed Embodiments

The disclosed embodiments relate to a recessed restrictor plate which is secured without gripping the inside surface or the outside surface of the curb box mouth.

2. Background of the Related Art

The disclosed restrictor plate assembly is an alternative to known storm drain covers, such as those described in U.S. Pat. No. 7,160,048 to Fattori, et al., for a Flow Restrictor Member, and U.S. Pat. No. 7,128,495, to Lill, et al., for a Curb Box Cover Assembly, both of which are entirely incorporated herein by reference. That is, the disclosed restrictor plate is an alternative to a storm drain cover which includes at least one clamp therefore for attaching the storm drain cover to the front surface of a storm drain structure which is, for example, cast iron. In addition, the disclosed restrictor plate assembly is an alternative to a restrictor plate which is attached or intended for attachment without a clamp to the front, street-facing surface of a storm drain structure.

SUMMARY OF THE DISCLOSED EMBODIMENTS

A restrictor plate assembly 10 is disclosed for restricting particulate flow into a curb box 12, through a mouth 14 thereof. The assembly 10 includes a restrictor plate 16 adapted for being secured at an inside surface 18 of the curb box mouth 14. A proximate clamp structure 20 is positioned at a proximate end 22 the restrictor plate 16 and a distal clamp structure 24 is positioned at a distal end 26 of the restrictor plate 16 that is widthwise spaced from the proximate end 26 of the restrictor plate. The proximate and distal clamp structures 20, 24 are adapted for securing the restrictor plate 16 within the curb box 12 without gripping the inside surface 18 or an outside surface 28 of the curb box mouth 14.

BRIEF DESCRIPTION OF THE FIGURES

Figures are provided, which are not limiting, and in which.

DETAILED DESCRIPTION OF THE DISCLOSED EMBODIMENTS

Figure 1:
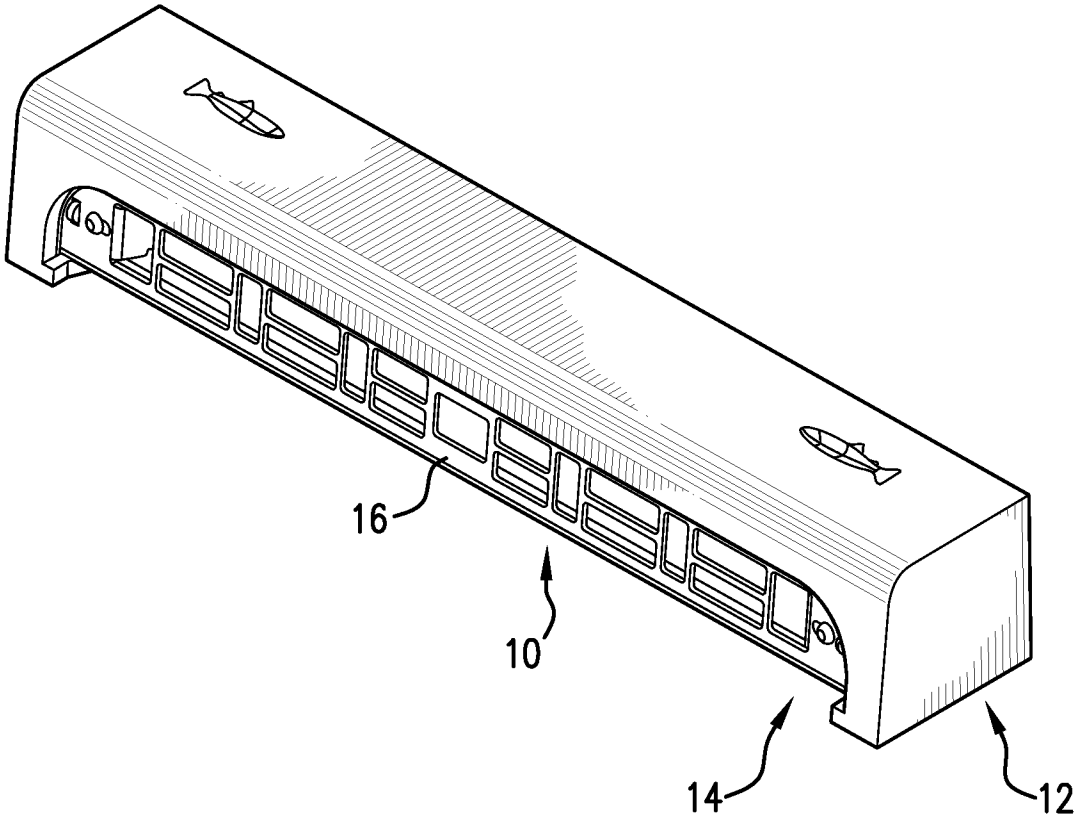
FIG. 1 is a front perspective view of the restrictor plate in a curb box.
Figure 2:
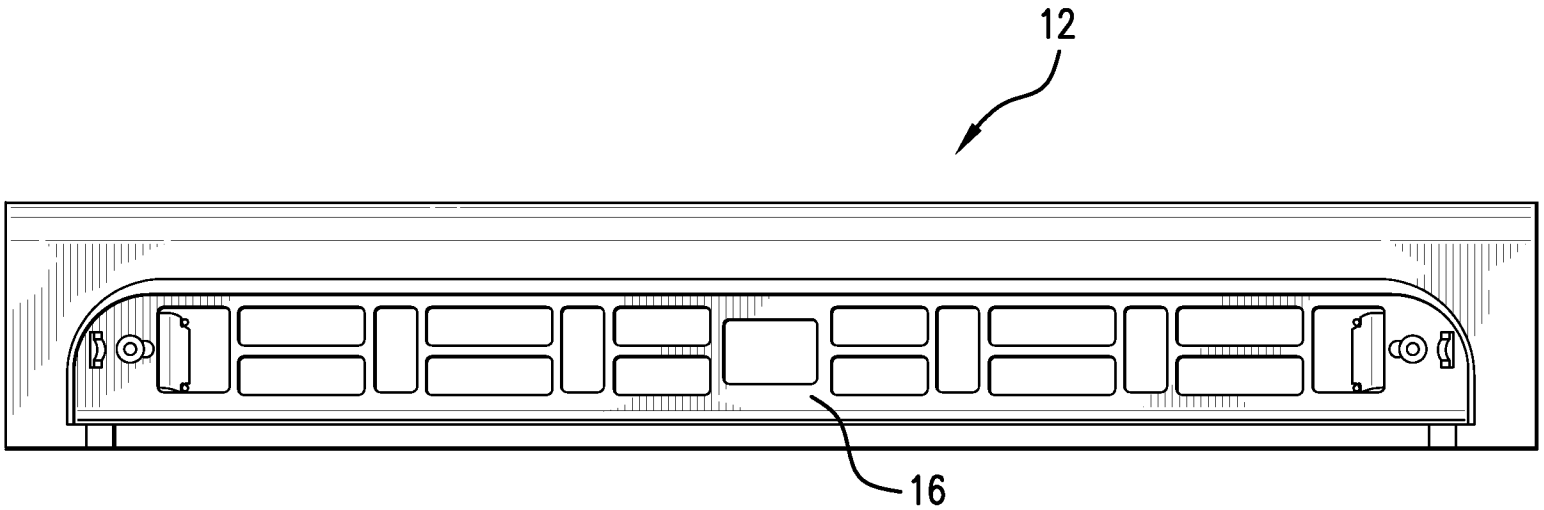
FIG. 2 is front elevational view of the restrictor plate in a curb box.
Figure 3:
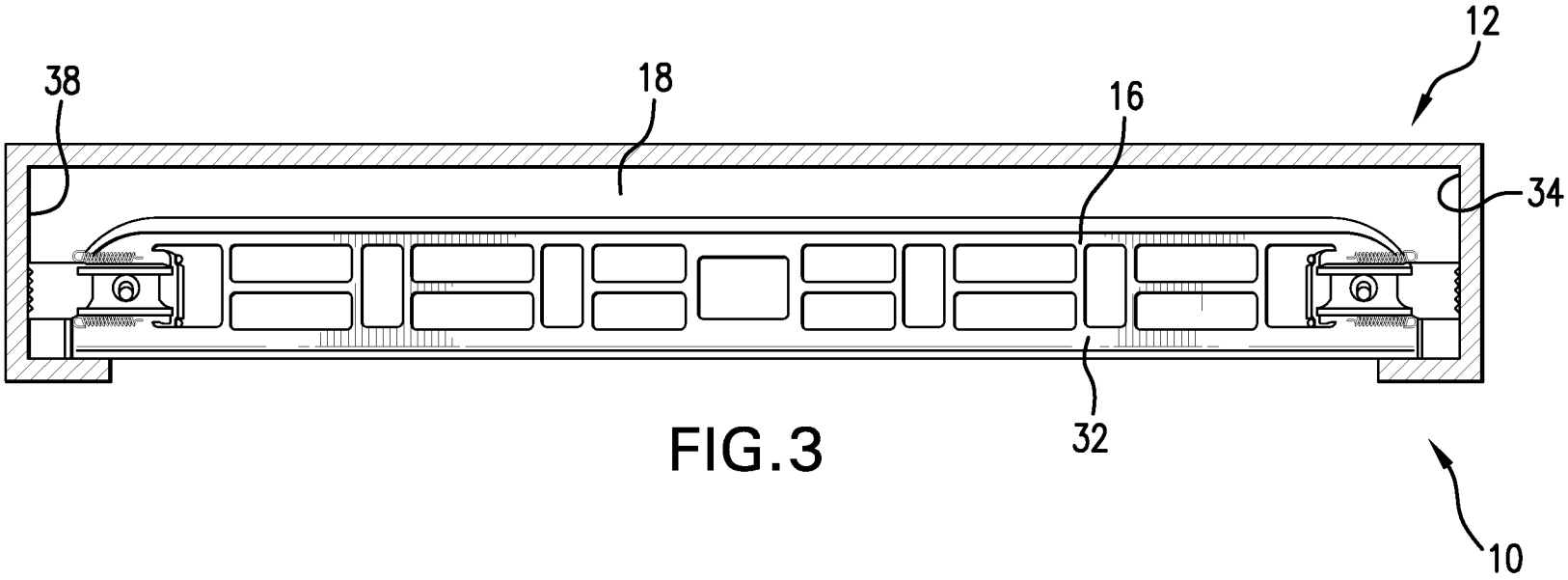
FIG. 3 is a rear elevational view of the restrictor plate in a curb box, with the curb box illustrated in a cross section.
Figure 4:
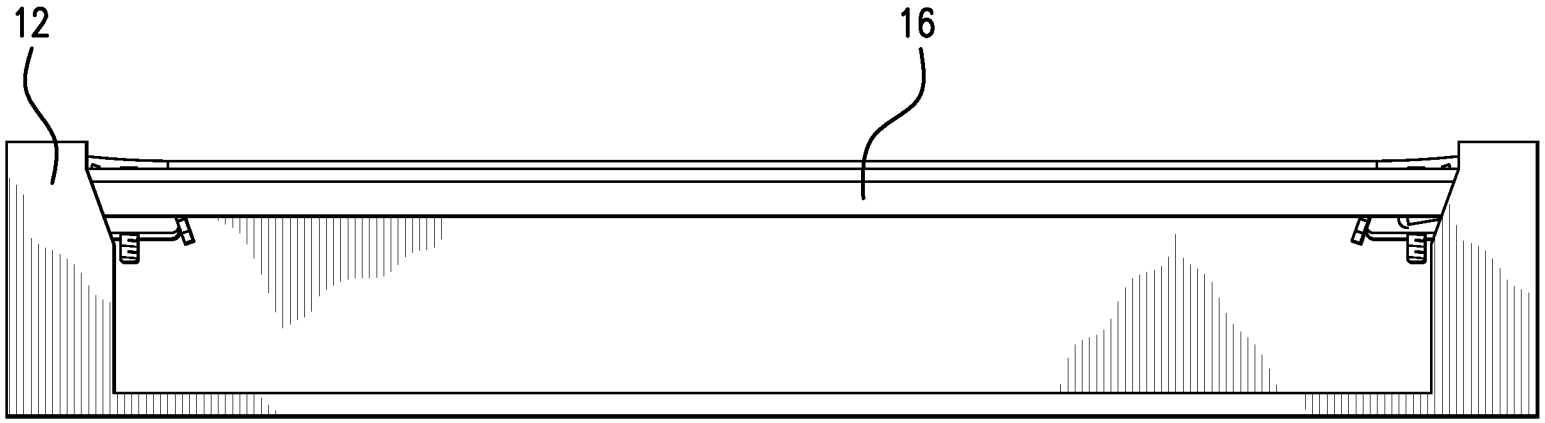
FIG. 4 is a bottom elevational view of the restrictor plate in a curb box.
Figure 6:
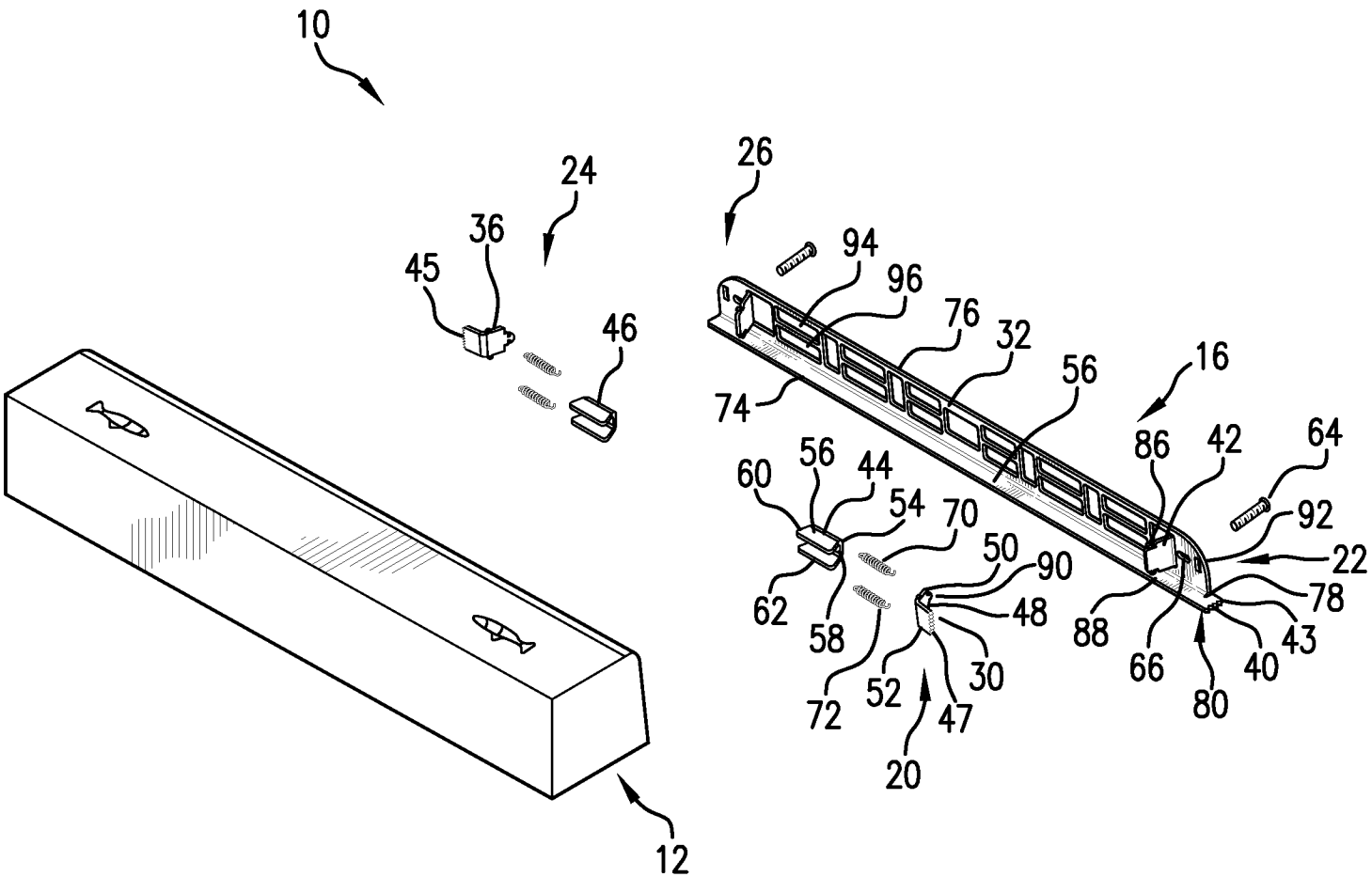
FIG. 6 is a rear perspective of FIG. 5.
Figure 7:
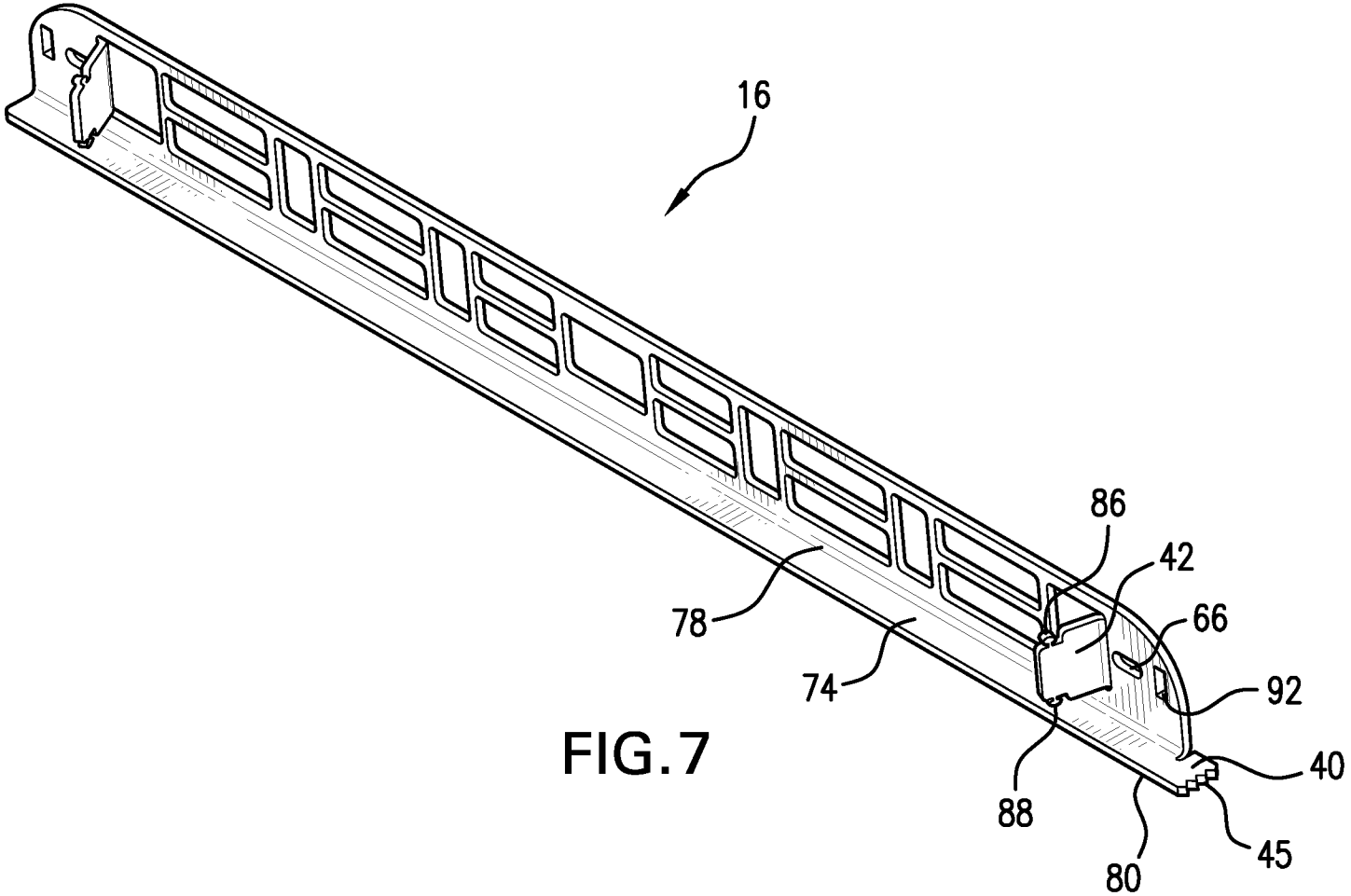
FIG. 7 is a rear perspective view of the restrictor plate in isolation from the assembly.

As illustrated in FIG. 1, a restrictor plate assembly 10 is disclosed for restricting particulate flow into a curb box 12, through a mouth 14 thereof. The assembly 10 includes a restrictor plate 16 as illustrated in FIGS. 5-7 adapted for being secured at an inside surface 18 of the curb box mouth 14, as illustrated in FIGS. 3 and 4.

Figure 5:
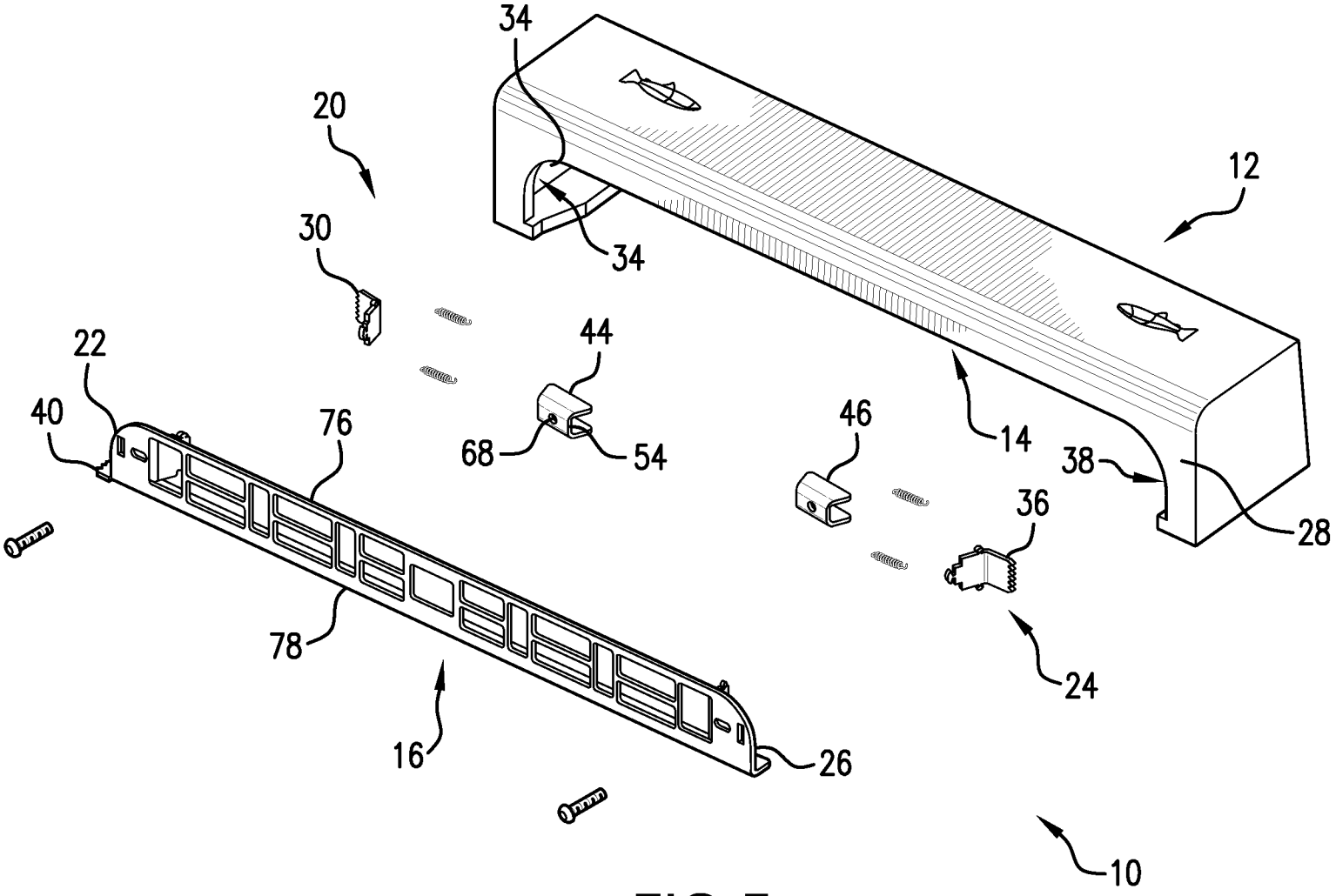
FIG. 5 is an exploded view of FIG. 1, illustrating the restrictor plate, the curb box and first and second clamp structures.

From an outside of the assembly, facing into the mouth of the curb box, the proximate side is the left side and the distal side, which is widthwise spaced from the proximate side, is the right side as illustrated in FIG. 5. With this relationship, a proximate clamp structure 20 is positioned at a proximate end 22 the restrictor plate 16 and a distal clamp structure 24 is positioned at a distal end 26 of the restrictor plate 16. As can be appreciated, the distal clamp structure 24 is width-wise spaced from the proximate end 26 of the restrictor plate.

According to the disclosed embodiments, the proximate and distal clamp structures 20, 24 are adapted for securing the restrictor plate 16 within the curb box 12 without gripping the inside surface 18 or an outside surface 28 of the curb box mouth 14. As illustrated in FIGS. 5 and 6, the proximate clamp structure 20 is substantially the same as the distal clamp structure 24.

The proximate clamp structure 20 includes a first proximate wedge member 30 that is adapted for pivotally connecting to a rear surface 32 of the restrictor plate 16. The proximate wedge member 30 extends rearward from the rear face of the restrictor plate 16, as illustrated in FIG. 6, and towards the proximate (same widthwise side) end 26 of the restrictor plate 16.

In use, the first proximate wedge member 30 of the proximate clamp structure 20 engages a proximate (same widthwise side) internal side wall 34 of the curb box 12. At the same time, a first distal wedge member 36 of the distal clamp structure 24 engages a distal internal side wall 38 of the curb box 12. The action of the first proximate wedge member and the first distal wedge member secures the restrictor plate 16 within the curb box, as indicated, without gripping the inside surface 18 or the outside surface 28 of the curb box mouth 14.

The restrictor plate 16 further includes a widthwise projecting tab 40, projecting proximately, that is, in the proximate direction, from the proximate end 22 of the restrictor plate 16. The tab 40 engages the proximate internal side wall 34 of the curb box 12 when securing the restrictor plate 16 therein. The tab 40 has a predetermined length, which extends in the widthwise direction for the restrictor plate 16.

With the tab 40, the restrictor plate 16 is capable of being substantially centered at the curb box mouth 14 prior to engaging the proximate clamp structure 20 or the distal clamp structure 24 within the curb box 12. That is, an installer positions the restrictor plate assembly 10 within the curb box 12, and physically moves the assembly 10 towards the proximate side wall 34 of the curb box 12. This will cause the proximate edge of the tab 40 to contact, or hit against, the proximate side wall 34 of the curb box 12. At this time, the assembly 10 is substantially centered at the opening of the curb box, albeit not secured at the opening. The proximate clamp structure 20 and the distal clamp structure 24 can be engaged without further concern of a centering placement of the assembly within the curb box 12.

As illustrated in FIG. 7, the proximate clamp structure 20 further includes a second proximate wedge member 42, fixed to the rear surface 32 of the restrictor plate 16. The second proximate wedge member 42 extends rearward from the restrictor plate 16 and toward the distal (opposing widthwise) end 26 of the restrictor plate 16. The second proximate wedge member 42 is positioned widthwise further (that is, more distal) from the widthwise proximate end 22 of the restrictor plate 16 than the first proximate wedge member 30.

Figure 10:
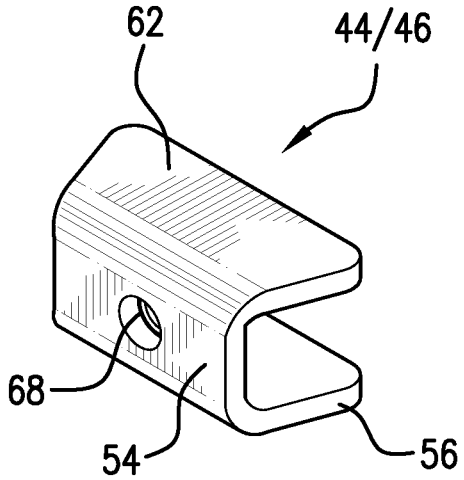
FIG. 10 is a perspective view of a wedge coupling member in isolation from the assembly.
Figure 11:
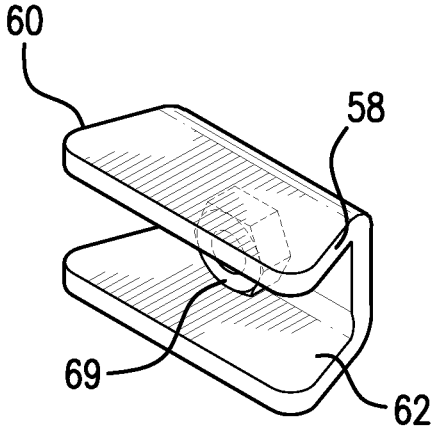
FIG. 11 is another perspective view of the wedge coupling member illustrated in FIG. 10.

The proximate clamp structure 20 also includes a proximate coupling member 44, illustrated in isolation in FIGS. 10 and 11. The coupling member 44 is positioned between the first proximate wedge member 30 and the second proximate wedge member 42.

The action of biasing the proximate coupling member 44 towards the resistor plate 16 pivots the first proximate wedge member 30 towards the proximate end of the restrictor plate 22 and against the proximate curb box wall. That is, the first proximate wedge member 30 and second proximate wedge member 42 are biased away from each other. This results in motion in the first proximate wedge member 30 do to the fixed configuration of the second proximate wedge member 42. Similarly, biasing a distal coupling member 46 towards the restrictor plate 16 pivots the first distal wedge member 36 towards the distal end of the restrictor plate 26 and against the distal curb box wall. The result is fixing the plate within the curb box.

Figure 8:
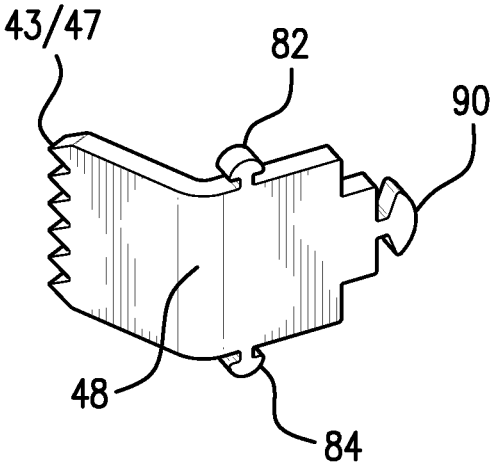
FIG. 8 is a perspective view of a pivotal clamp wedge member in isolation from the assembly.
Figure 9:
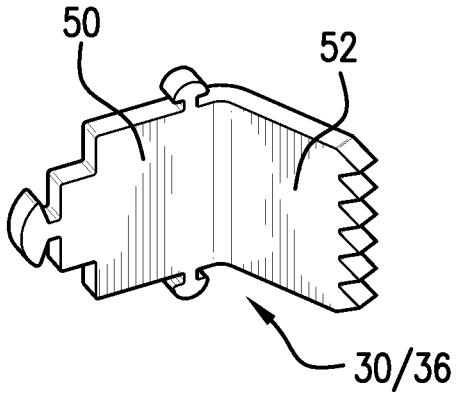
FIG. 9 is another perspective view of the pivotal clamp wedge member illustrated in FIG. 8.

As illustrated in FIGS. 8 and 9, a free end 43 of the first proximate wedge member 30 is a jagged edge and a free end 45 of the tab 40 is a jagged edge. Both of these free edges are adapted for gripping the proximate internal side wall 34 of the curb box 12. Similarly, a free end 47 of the first distal wedge member 36 is a jagged edge, which is adapted for gripping the distal internal side wall 38 of the curb box 12.

The first proximate wedge member 30 is essentially a machined plate having a fulcrum bend 48 extending in a restrictor plate height-wise direction. The bend 48 divides the first proximate wedge member 30 into a first portion 50 which is closer to the restrictor plate 16 and a second portion 52 which is further away, or further back, from the restrictor plate 16. When clamping structures 20, 24 have clamped the restrictor plate 16 within the curb box 12, the first portion 50 of the first proximate wedge member 30 is at a substantially acute angle to the restrictor plate 16 and the second portion 52 of the first proximate wedge member 30 is substantially parallel with the restrictor plate 16. In this configuration, the edge 43 digs into the side wall of the curb box for substantially permanent placement of the restrictor plate.

As illustrated in FIG. 7, the second proximate wedge member 42 is disposed at an acute angel to the restrictor plate 16. The proximate coupling member 44, as seen in FIGS. 10 and 11, includes a base 54 which is parallel with the restrictor plate 16, and a first plate member 56 extending from the base 54 substantially perpendicular to the restrictor plate 16.

The first plate member 56 is oriented so as to have a proximate edge 58 and a distal edge 60. The proximate and distal edges 58, 60 are formed at angles so as to substantially rest against the first and second proximate wedge members 30, 42, respectively, when the restrictor plate 16 is installed in the curb box 12. In other words, from a plan view, the first plate member 56 has the appearance of a truncated "V" shaped wedge, with the effective fulcrum facing towards the restrictor plate 16.

The proximate coupling member 44 includes a second plate member 62 extending from the base 54 substantially parallel with the first plate member 56. The second plate member 62 has a same shape as the first plate member 56 and is height-wise spaced from the first plate member 56. As can be appreciated, the proximate coupling member 44, and matching distal coupling member 46, can be stamped and bent into shape from a steel plate.

The proximate clamp structure 20 includes a bolt which passes through an opening 66 in the restrictor plate 16 and connects with an opening 68 in the base 54 of the proximate coupling wedge member 44. A receiving nut 69 is secured via, for example, welding, to the surface of the base 54 of the coupling 44 which faces away from the restrictor plate upon installation. The bolt is used for drawing the proximate coupling member 44 towards the restrictor plate 16. As can be appreciated, a similar bolt/nut with related openings are provided for the matching configuration and purpose in the matching distal clamp structure 24 of the plate assembly 10.

As illustrated in FIG. 7, the opening 66 in the restrictor plate 16 is a widthwise extending slot. The opening may be circular, though the slot shape provides for easier manipulation when aligning the bolt 64 with the holes in both the restrictor plate 16 and the base 54 of the coupling member 44.

Figure 12:
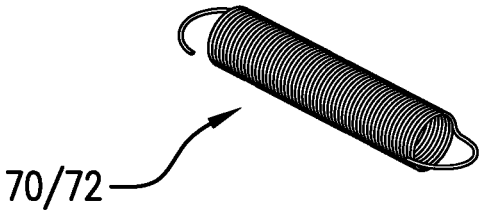
FIG. 12 is a coil spring in isolation from the assembly.

The proximate clamp structure 20 includes a first spring 70, illustrated in FIGS. 5 and 6, and in isolation in FIG. 12. The spring 70 connects the first proximate wedge member 30 to the second proximate wedge member 38. This connection stabilizes the proximate clamp structure 20 prior to securing the restrictor plate 16 within the curb box 12. This is helpful when transporting the assembly 10 to a worksite or when placing the assembly 10 within the mouth 14 of the curb box 12, pre-installation. As can be appreciated, the available extra space provided by the slot opening 66 in the plate 16 assists an installer in connecting the bolt 64 with the opening 68 in the base 54 of the coupling member 44.

The proximate clamp structure 20 includes a second spring 72. The second spring 72 is substantially the same as the first spring 70 and is height-wise spaced from the first spring 70 in the assembly 10. The second spring 72 also serves to connect the first proximate wedge member 30 to the second proximate wedge member 38. By action of the first spring 70 and second spring 72, the proximate clamp structure 20 is further stabilized prior to securing the restrictor plate 16 within the curb box 12.

As illustrated in FIG. 7, a width-wise extending flange 74 is provided, projecting rewardly from one of a top edge 76 of the restrictor plate and a bottom edge 78 of the restrictor plate 16. In the illustration, the flange is on the bottom edge 78 of the plate 16, helping to stabilize the assembly 10 during installation. The flange 74 is illustrates as being continuous along the widthwise expanse of the plate, but it is not necessarily so. If the curb box angled downwardly into its throat, the flange could be angled the same way for providing a balancing supporting structure. However, as illustrated, the flange 74 extends lightly less than perpendicularly, relative to the plate itself, and from the rear of the plate.

In addition, the tab 40 extends from a proximate end 80 of the flange 74. Moreover, the tab 40 has the same depth-wise span (into the throat of the curb box) as the flange. As indicated, this depth-wise span need only be enough to prevent the assembly 10 from buckling during transportation, assembly and use.

As illustrated in FIGS. 7, 8 and 9, the first proximate wedge member 30 includes a first spring engaging tab 82 and a height-wise spaced second spring engaging tab 84, each of which is essentially a half-round shape, spaced from the wedge member 30 by a tab neck. The second proximate wedge member 42 includes a third spring engaging tab 86 and a height-wise spaced fourth spring engaging tab 88. The first spring 70 is connected across the first and third spring engaging tabs 82, 86 and the second spring 72 is connected across the second and fourth spring engaging tabs 86, 88. The spaced, half-round shape provides an effective latch for the end rings or loops of the springs 70/72, which are tension coil springs.

The first proximate wedge member 30 includes a first restrictor plate engaging tab 90. The tab 90 is also a half-round shape spaced from the edge of the wedge member by a tab neck. The restrictor plate 16 includes a proximate tab opening 92 for receiving the restrictor plate engaging tab 90, where the opening is illustrated as a height-wise extending slot.

This configuration enables the proximate wedge member 30 to pivoting against the restrictor plate 16. However, once installed and bolted into the permanent configuration in the curb box, with the matching distal side configuration engaging the curb box, the engaging tabs on both sides can be broken off via hitting with a hammer.

As illustrated in FIG. 7, the restrictor plate includes a plurality of openings, including a first opening 94 and a second opening 96. These openings are for filtering particulates above predetermined size from entering the curb box 12. As illustrated, there are plural (twelve as illustrated) horizontally extending openings and plural (four as illustrated) vertically extending openings. Each opening is sized based on government restrictions for minimizing the flow of large debris into the curb box.

As illustrated, the restrictor plate 16 has a smaller surface area than the curb box mouth 14 to enable passing there through. The distal and proximate top edges of the plate are rounded for this purpose. In addition, the restrictor plate 16 and clamp structures 20, 24 are manufactured from core 10 steel.

A restrictor plate assembly 10 has been disclosed for restricting particulate flow into a curb box 12, through a mouth 14 thereof. The assembly 10 includes a restrictor plate 16 adapted for being secured at an inside surface 18 of the curb box mouth 14. A proximate clamp structure 20 is positioned at a proximate end 22 the restrictor plate 16 and a distal clamp structure 24 is positioned at a distal end 26 of the restrictor plate 16 that is widthwise spaced from the proximate end 26 of the restrictor plate. The proximate and distal clamp structures 20, 24 are adapted for securing the restrictor plate 16 within the curb box 12 without gripping the inside surface 18 or an outside surface 28 of the curb box mouth 14.

The disclosed embodiments are those detailed above, illustrated in the figures and recited in the claims. The embodiments are not intended on limiting the scope of the claims but are examples of the overall breath of the invention.

I claim:

1. A restrictor plate assembly for restricting particulate flow into a curb box, through a mouth thereof, the assembly comprising:

a restrictor plate adapted for being secured at an inside surface of the curb box mouth;

a proximate clamp structure positioned at a proximate end of the restrictor plate and a distal clamp structure positioned at a distal end of the restrictor plate that is widthwise spaced from the proximate end of the restrictor plate, the proximate and distal clamp structures respectively comprising first proximate and first distal wedge members each adapted for pivotally connecting to a rear surface of the restrictor plate, the first proximate and first distal wedge members extending rearward from the restrictor plate and respectively towards the proximate and distal ends of the restrictor plate; and a widthwise projecting tab projecting proximately from the proximate end of the restrictor plate, wherein the first proximate wedge member is adapted for engaging a proximate internal side wall of the curb box and the first distal wedge member is adapted for engaging a distal internal side wall of the curb box for securing the restrictor plate within the curb box, and wherein the widthwise projecting tab is adapted for engaging the proximate internal side wall when securing the restrictor plate therein, whereby the restrictor plate is capable of being substantially centered at the curb box mouth prior to engaging the first proximate wedge member with the proximate internal side wall or the first distal wedge member with the distal internal side wall.

2. The assembly of claim 1, wherein the proximate clamp structure further includes:

a second proximate wedge member fixed to the rear surface of the restrictor plate 16, wherein:

the second proximate wedge member extends rearward from the restrictor plate and towards the distal end of the restrictor plate; and the second proximate wedge member is positioned further from the proximate end of the restrictor plate than the first proximate wedge member 30; and a proximate coupling member positioned between the first proximate wedge member and the second proximate wedge member;

wherein, biasing the proximate coupling member towards the restrictor plate pivots the first proximate wedge member towards the proximate end of the restrictor plate and biasing a distal coupling member towards the restrictor plate pivots the first distal wedge member towards the distal end of the restrictor plate.

3. The assembly of claim 2, where a free end of the first proximate wedge member has a jagged edge and a free end of the tab has a jagged edge, both of which are adapted for gripping the proximate internal side wall 34 of the curb box, and a free end of the first distal wedge member has a jagged edge, which is adapted for gripping the distal internal side wall of the curb box.

4. The assembly of claim 2, wherein the first proximate wedge member includes:

a fulcrum bend extending in a plate height-wise direction, dividing the first proximate wedge member into a first portion which is closer to the restrictor plate and a second portion which is further from the restrictor plate; and when the clamping structures have clamped the restrictor plate within the curb box:

the first portion of the first proximate wedge member is disposed at an acute angle to the restrictor plate and the second portion of the first proximate wedge member is substantially parallel with the restrictor plate.

5. The assembly of claim 4, wherein the second proximate wedge member is disposed at an acute angel to the restrictor plate.

6. The assembly of claim 5, wherein:

the proximate coupling member includes a base which is parallel with the restrictor plate, and a first plate member extending from the base is substantially perpendicular to the restrictor plate;

the first plate member is oriented so as to have a proximate edge and a distal edge; and the proximate and distal edges of the first plate member are formed at angels so as to substantially rest against the first and second proximate wedge members, respectively, when the restrictor plate is installed in the curb box.

7. The assembly of claim 6, wherein:

the proximate coupling member includes a second plate member extending from the base and that is substantially parallel with the first plate member; and the second plate member has a shape that is the same as the first plate member and is height-wise spaced from the first plate member.

8. The assembly of claim 7, wherein the proximate clamp structure includes a bolt which passes through an opening in the restrictor plate and connects with an opening in the base of the proximate coupling wedge member for drawing the proximate coupling member towards the restrictor plate.

9. The assembly of claim 8, wherein the opening in the restrictor plate is a widthwise extending slot.

10. The assembly of claim 7, wherein the proximate clamp structure includes a first spring connecting the first proximate wedge member to the second proximate wedge member for stabilizing the proximate clamp structure prior to securing the restrictor plate within the curb box.

11. The assembly of claim 10, wherein the proximate clamp structure includes a second spring height-wise spaced from the first spring and connecting the first proximate wedge member to the second proximate wedge member which, with the first spring, stabilizes the proximate clamp structure prior to securing the restrictor plate within the curb box.

12. The assembly of claim 11, wherein:

the first proximate wedge member includes a first spring engaging tab and a height-wise spaced second spring engaging tab and the second proximate wedge member includes a third spring engaging tab and a height-wise spaced fourth spring engaging tab, and wherein the first spring is connected across the first and third spring engaging tabs and the second spring is connected across the second and fourth spring engaging tabs.

13. The assembly of claim 1, including a width-wise extending flange projecting rearwardly from one of a top edge of the restrictor plate and a bottom edge of the restrictor plate.

14. The assembly of claim 13, where the tab extends outwardly from a proximate end of the flange.

15. The assembly of claim 1, wherein the first proximate wedge member includes a first restrictor plate engaging tab and the restrictor plate includes a proximate tab opening for receiving the restrictor plate engaging tab so that the proximate wedge member is capable of pivoting against the restrictor plate.

16. The assembly of claim 1, wherein the restrictor plate includes a plurality of openings, including a first opening and a second opening, for filtering particulates above predetermined size from entering the curb box.

17. A combination comprising a curb box and the restrictor assembly of claim 1, where the restrictor plate has a surface area smaller than an area of the curb box mouth to enable passing of the restrictor plate therethrough.

18. The assembly of claim 1 wherein the restrictor plate and proximate and distal clamp structures are manufactured from weathering steel.

* * * * *